US007845951B1

(12) United States Patent
Goon

(10) Patent No.: US 7,845,951 B1
(45) Date of Patent: Dec. 7, 2010

(54) ROTATABLE ADAPTER FOR ELECTRICAL PLUGS

(76) Inventor: Ngoon Goon, 2 Pheasant Run, Freehold, NJ (US) 07728

( * ) Notice: Subject to any disclaimer, the term of this patent is extended or adjusted under 35 U.S.C. 154(b) by 0 days.

(21) Appl. No.: 12/608,041

(22) Filed: Oct. 29, 2009

Related U.S. Application Data

(60) Provisional application No. 61/219,950, filed on Jun. 24, 2009.

(51) Int. Cl.
*H01R 39/00* (2006.01)

(52) U.S. Cl. ..... 439/21

(58) Field of Classification Search ..... 439/13, 439/11, 171, 21, 22, 640
See application file for complete search history.

(56) References Cited

U.S. PATENT DOCUMENTS 6,862,403 B2 * 3/2005 Pedrotti et al. ..... 392/395
7,311,533 B1 * 12/2007 Lin et al. ..... 439/131
7,462,074 B1 * 12/2008 Devlin et al. ..... 439/640
2002/0182910 A1 12/2002 Kiughadush

* cited by examiner

*Primary Examiner*—Javaid Nasri
(74) *Attorney, Agent, or Firm*—L. C. Begin & Associates, PLLC.

(57) ABSTRACT

One embodiment of an adapter for an electrical plug may include a bottom connector, a top connector and an electrical connection mechanism. The bottom connector may include a plurality of male connectors capable of being inserted in a wall socket. The top connector may be rotatably coupled to the bottom connector. The top connector may be capable of rotating in a plane parallel to a plane of the wall socket. The top connector may include a plurality of female connectors for receiving the electrical plug. The plurality of female connectors may be electrically coupled to the plurality of male connectors, and may be disposed perpendicular to the plurality of male connectors. The electrical connection mechanism may be configured to electrically coupling the plurality of male connectors and the plurality of female connectors.

10 Claims, 12 Drawing Sheets

ROTATABLE ADAPTER FOR ELECTRICAL PLUGS

CROSS REFERENCE TO RELATED APPLICATION

This application claims the benefit of U.S. Provisional Application No. 61/219,950 filed on Jun. 24, 2009, the disclosure of which is incorporated by reference.

FIELD OF THE DISCLOSURE

The present disclosure relates generally to adapters for electrical plugs, and more particularly, to a rotatable adapter for an electrical plug.

BACKGROUND OF THE DISCLOSURE

Typically, when an electricity-powered device needs electrical power, a plug of the device is plugged into a wall socket, configured on a wall. The wall socket includes slots where male prongs of the plug are inserted. Generally, wall sockets are positioned at various locations on the wall, such as a bottom portion of the wall, a center portion of the wall, and the like. Most of the wall sockets are positioned at the bottom portion of the wall surface so that the wall sockets may be hidden behind household furniture.

Generally, the plug is perpendicularly inserted in the wall socket such that it protrudes away from the wall. Due to this projection of the plug, it may be inconvenient to place the furniture close to the wall. Further, when the plug is positioned perpendicular to the wall, movement of the furniture may hit the plug and cause a stress on the neck of the plug. Specifically, there may be a possibility of the plug being dislodged from the wall socket. In addition, a wire of the device may bend at the neck of the plug and may be stretched, thereby causing the stress on the neck of the plug.

SUMMARY

One embodiment of an adapter for an electrical plug may include a bottom connector. The bottom connector may include a plurality of male connectors. The plurality of male connectors is configured to be inserted in a wall socket. The adapter may also include a top connector. The top connector may be rotatably coupled to the bottom connector. The top connector may be capable of rotating in a plane parallel to a plane of the wall socket. The top connector may include a plurality of female connectors for receiving an electrical plug. The plurality of female connectors may be electrically coupled to the plurality of male connectors, and may be positioned perpendicular to the plurality of male connectors. The adapter may also include an electrical connection mechanism. The electrical connection mechanism may be configured to electrically coupling the plurality of male connectors and the plurality of female connectors.

BRIEF DESCRIPTION OF THE DRAWINGS

These and other features and advantages of the present disclosure will be apparent from the following detailed description of preferred embodiments and best mode, appended claims, and accompanying drawings in which:

Like reference numerals refer to like parts throughout the description of several views of the drawings.

DETAILED DESCRIPTION OF THE DISCLOSURE

Figure 1:
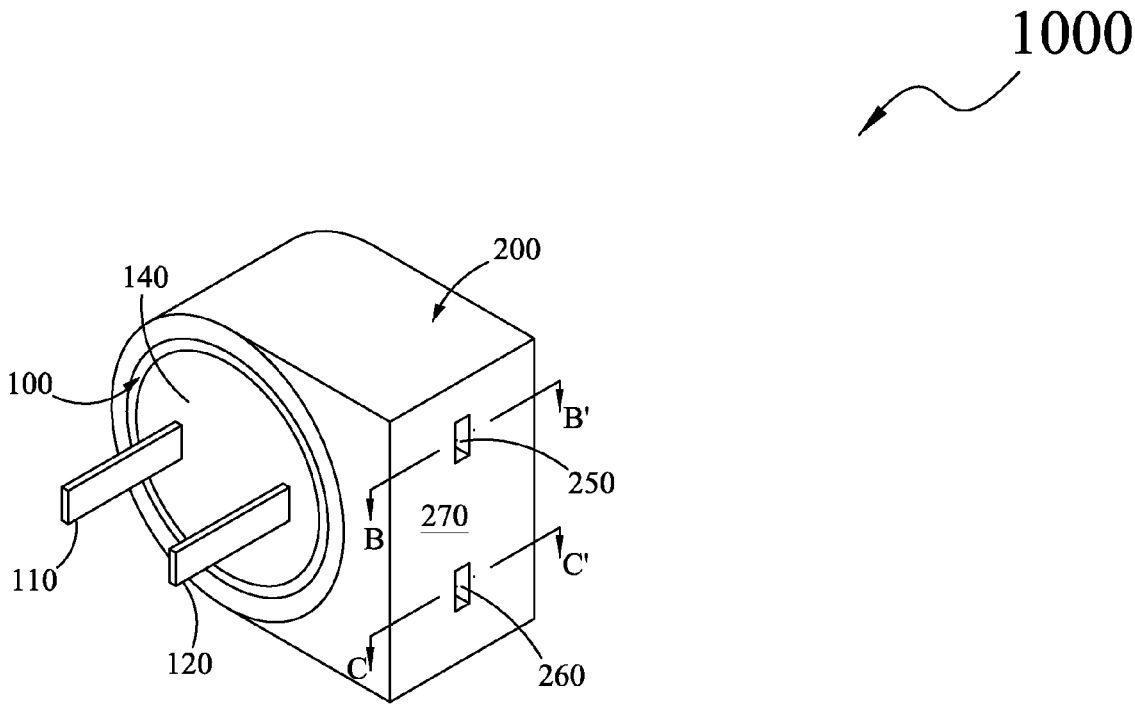
FIG. 1 is a perspective view of an embodiment of an adapter for an electrical plug.

The exemplary embodiments described herein provide detail for illustrative purposes and are subject to many variations in structure and design. It should be emphasized, however, that the present disclosure is not limited to a particular power outlet organizer, as shown and described. It is understood that various omissions and substitutions of equivalents are contemplated as circumstances may suggest or render expedient, but these are intended to cover the application or embodiment without departing from the spirit or scope of the claims of the present disclosure. Also, it is to be understood that the phraseology and terminology used herein are for the purpose of description and should not be regarded as limiting.

Unless limited otherwise, the terms "coupled," "attached," "carried," and variations thereof herein are used broadly and encompass direct and indirect arrangements. The terms "a" and "an" herein do not denote a limitation of quantity, but rather denote the presence of at least one of the referenced items.

FIGS. 1-7 depict an embodiment of an adapter 1000 for an electrical plug 16. The adapter 1000, further having female connectors (not shown) for plugging the electrical plug 16 therein.

The adapter 1000 may include a bottom connector 100. The bottom connector 100 may be cylindrical in shape with an outer curved surface 150 ("surface 150") and may include a socket plate 140. The socket plate 140 may be a flat circular surface that may contact a wall socket 10. The bottom connector 100 may include a stepped-down surface 160 at a circular surface opposite to the socket plate 140 of the bottom connector 100.

The bottom connector 100 may also include a plurality of male connectors. The plurality of male connectors may include a first male connector 110 that may be capable of being inserted in the wall socket 10 (shown in FIG. 7). Specifically, the first male connector 110 may be carried by the bottom connector 100. More specifically, the first male connector 110 may protrude perpendicularly from the socket plate 140 and may fit into the female connectors of the wall socket 10. In one form, the first male connector 110 may be carried by the bottom connector 100 using an injection molding technique. Alternatively, the first male connector 110 may be carried by the bottom connector 100 by using other techniques. Further, the first male connector 110 may be composed of a conductive material, such as copper, aluminum, silver, and the like. However, the first male connector 110 may be composed of any other conductive material without departing from the spirit and scope of the present disclosure.

Figure 2:
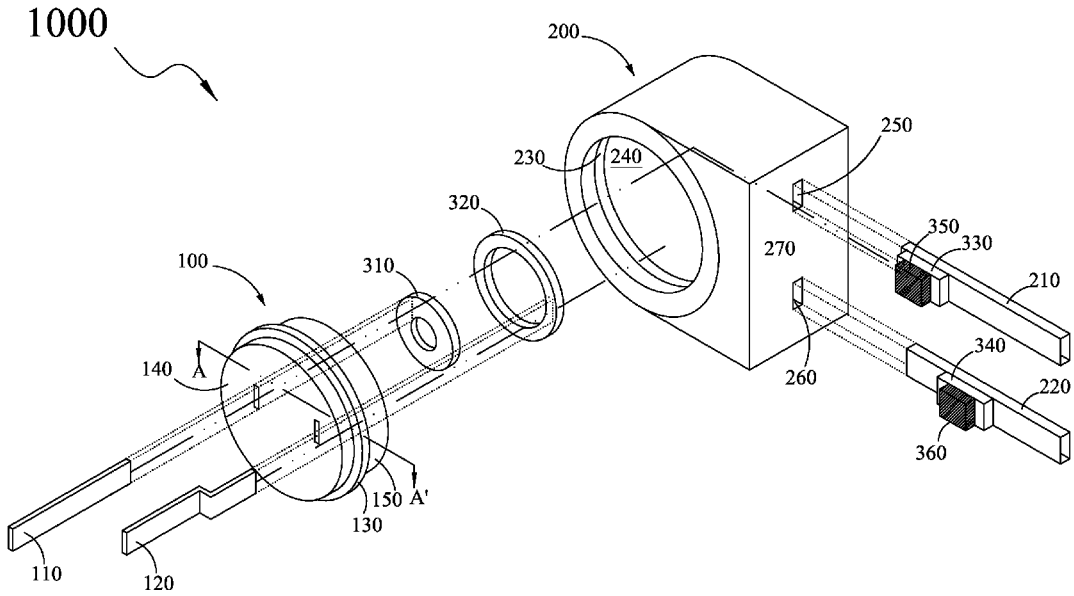
FIG. 2 is an exploded view of the adapter of FIG. 1 showing the adapter having a top connector, a bottom connector and an electrical connection mechanism.

The plurality of male connectors may also include a second male connector 120 that may be capable of being inserted in the wall socket 10. Specifically, the second male connector 120 may be carried by the bottom connector 100. More specifically, the second male connector 120 may protrude perpendicularly from the socket plate 140 and may fit into the female connectors of the wall socket 10. In one form, the second male connector 120 may be carried by the bottom connector 100 using an injection molding technique. Alternatively, the second male connector 120 may be carried by the bottom connector 100 by using other techniques. In one form, the second male connector 120 may be formed in a bent shape, as best shown in FIG. 2. Further, the second male connector 120 may be composed of a conductive material, such as copper, aluminum, silver, and the like. However, the second male connector 120 may be composed of any other conductive material without departing from the spirit and scope of the present disclosure.

The bottom connector 100 may also include an annular rib 130 that may be carried on the surface 150 of the bottom connector 100, as best shown in FIG. 2.

Particularly, the annular rib 130 may project outwardly from the surface 150 of the bottom connector 100. The annular rib 130 may be composed of a resilient material, such as plastic, that may enable the annular rib 130 to bend when a pressure is applied thereon. However, the annular rib 130 may be capable of retaining an original shape upon removal of the pressure.

The adapter 1000 may further include a top connector 200 rotatably coupled to the bottom connector 100. As best shown in FIG. 2, the top connector 200 may be configured as a hollow cylinder with an inner curved surface 240 for receiving the bottom connector 100 therein. In one form, the top connector 200 may extend from the hollow cylinder into a cube or a cuboid having a flat surface 270. The hollow cylinder of the top connector 200 may be communicated with an opening 250 and an opening 260 configured on the flat surface 270.

The top connector 200 may include an annular groove 230 configured on the inner curved surface 240. The annular groove 230 may be capable of accommodating the annular rib 130. Accommodation of the annular rib 130 in the annular groove 230 may rotatably couple the bottom connector 100 and the top connector 200. The annular groove 230 may be composed of a resilient material, such as plastic or rubber that may enable the annular groove 230 to flex.

In order to couple to the bottom connector 100 with the top connector 200, the bottom connector 100 may be pushed into the hollow cylinder of the top connector 200. Upon application of a pressure on the bottom connector 100 and the top connector 200, the annular rib 130 to be fit into the annular groove 230. The annular rib 130 may rotate in the annular groove 230. The annular groove 230 may enable the top connector 200 to be rotatably coupled with the bottom connector 100. However, other techniques may be utilized to rotatably couple the top connector 200 with the bottom connector 100 without departing from the spirit and scope of the present disclosure. The top connector 200 and the bottom connector 100 may be separated by a predefined clearance to enable the rotation. Further, the top connector 200 may be capable of rotating both in clockwise and anti-clockwise direction with respect to the plane 14 (shown by double-ended arrow in FIG. 7).

The top connector 200 may include a plurality of female connectors. The plurality of female connectors may include a first female connector 210. The first female connector 210 may be carried by the top connector 200 in the opening 250. The first female connector 210 may be positioned perpendicularly to the first male connector 110. Further, the first female connector 210 may be electrically coupled to the first male connector 110. Furthermore, the first female connector 210 may be composed of a conductive material, such as copper, aluminum, silver, and the like. However, the first female connector 210 may be composed of any other conductive material without departing from the spirit and scope of the present disclosure.

Figure 7:
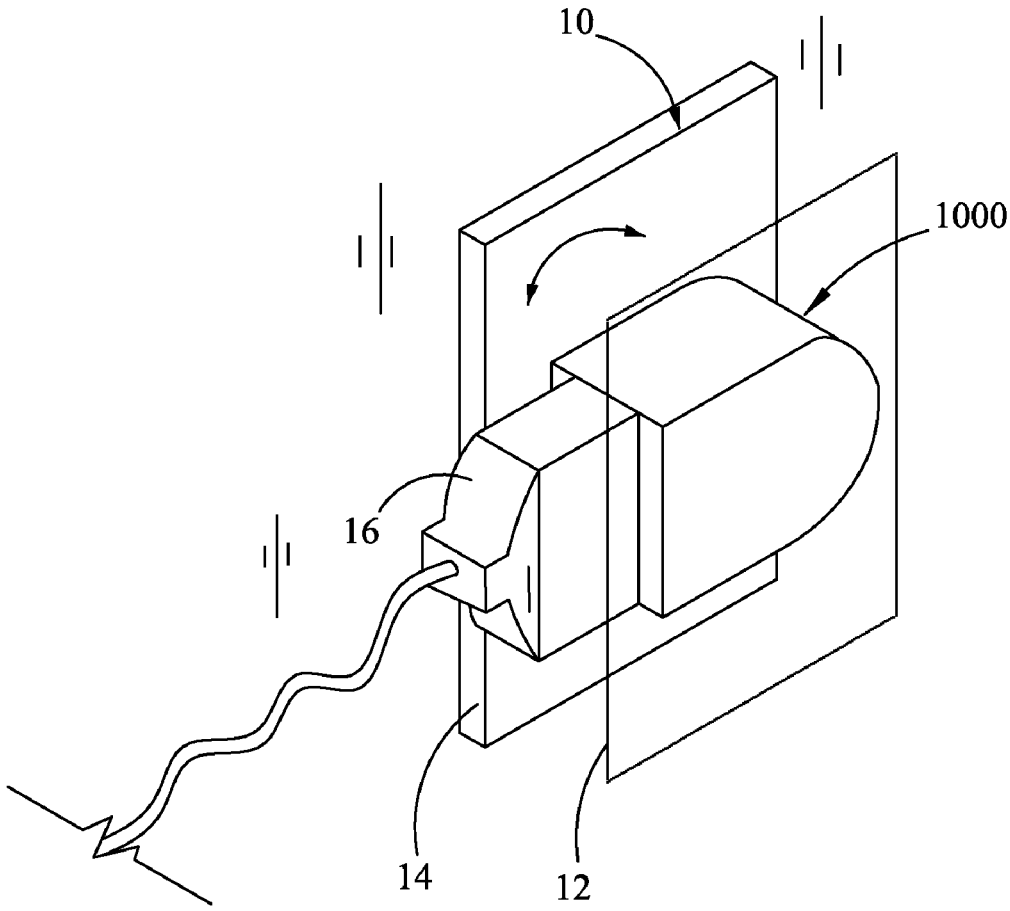
FIG. 7 is a perspective view of the adapter of FIG. 1, showing the adapter plugged into a wall socket.
Figure 8:
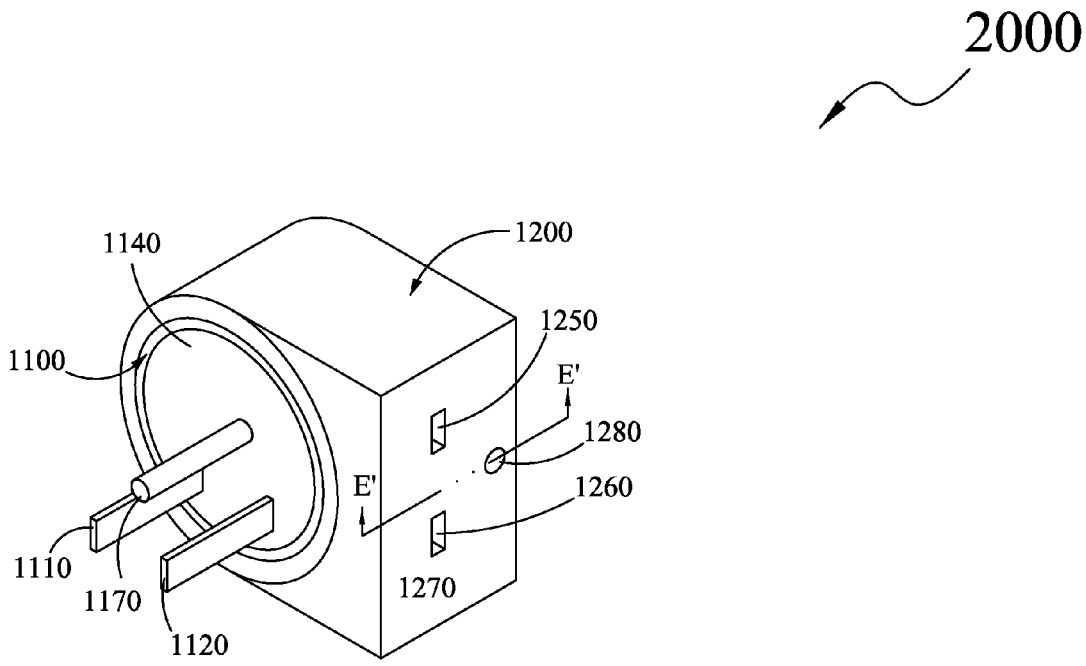
FIG. 8 is a perspective view of another embodiment of an adapter for an electrical plug.

The plurality of female connectors may also include a second female connector 220. The second female connector 220 may be carried by the top connector 200 in the opening 260. The second female connector 220 may be positioned perpendicularly to the second male connector 120. Further, the second female connector 220 may be electrically coupled to the second male connector 120. Furthermore, the second female connector 220 may be composed of a conductive material, such as copper, aluminum, silver, and the like. However, the second female connector 220 may be composed of any other conductive material, without departing from the spirit and scope of the present disclosure. Further, the first female connector 210 and the second female connector 220 ("female connectors") may be capable of rotating in a plane 12 parallel to a plane 14 of the wall socket 10, as shown in FIG. 7. Rotation of the female connectors may be enabled by the rotation of the top connector 200 over the bottom connector 100 by utilizing the annular rib 130 and the annular groove 230.

Figure 3A:
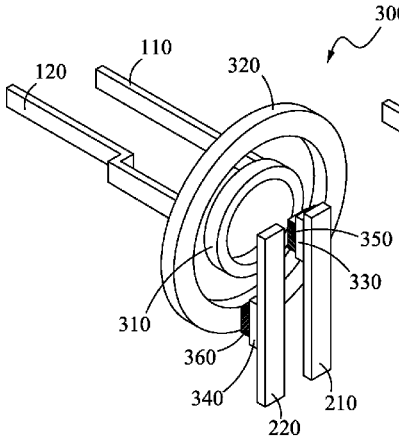
FIGS. 3A-3C are a series of three perspective views of the electrical connection mechanism of the adapter of FIG. 1 showing rotation of a plurality of female connectors carried by the top connector with respect to a plurality of male connectors carried by the bottom connector.
Figure 3B:
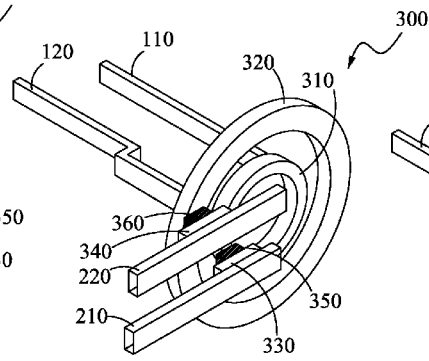
Figure 3C:
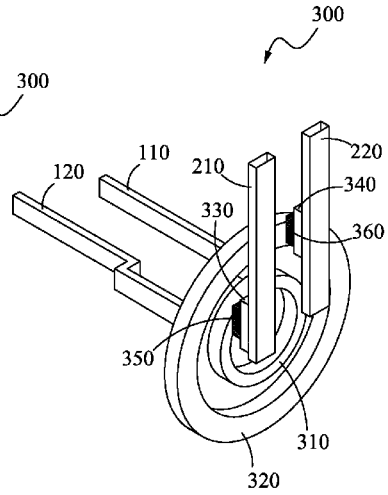
Figure 4:
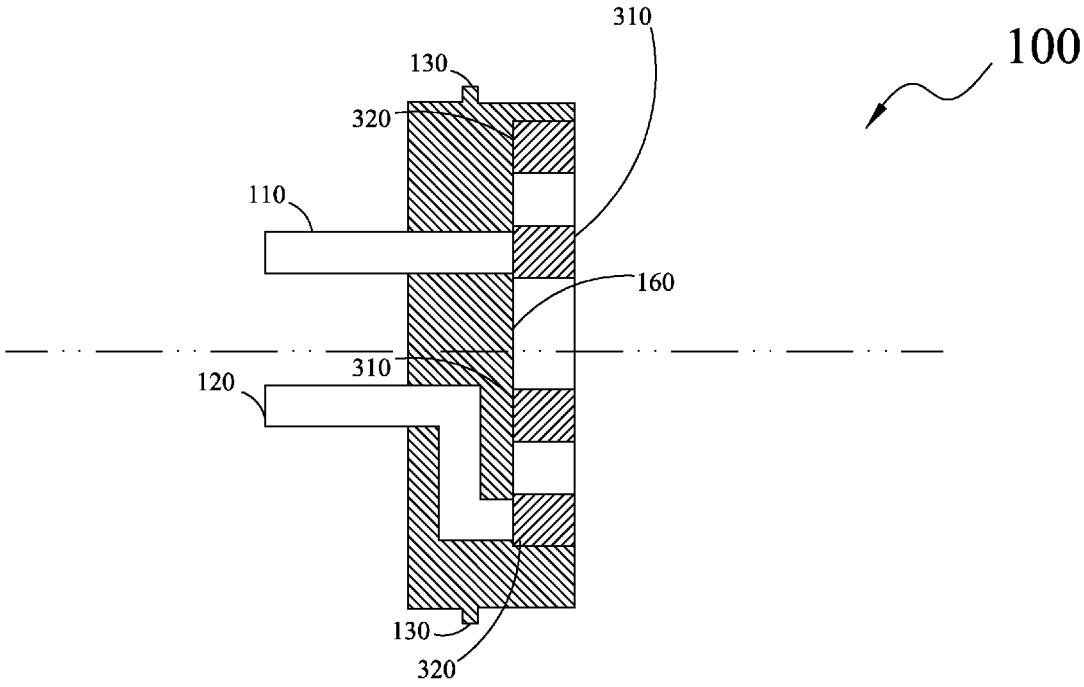
FIG. 4 is a sectional view of the bottom connector of the adapter of FIG. 1 along a section line A-A' (shown in FIG. 2), showing the bottom connector having the male connectors and conductive members.
Figure 5:
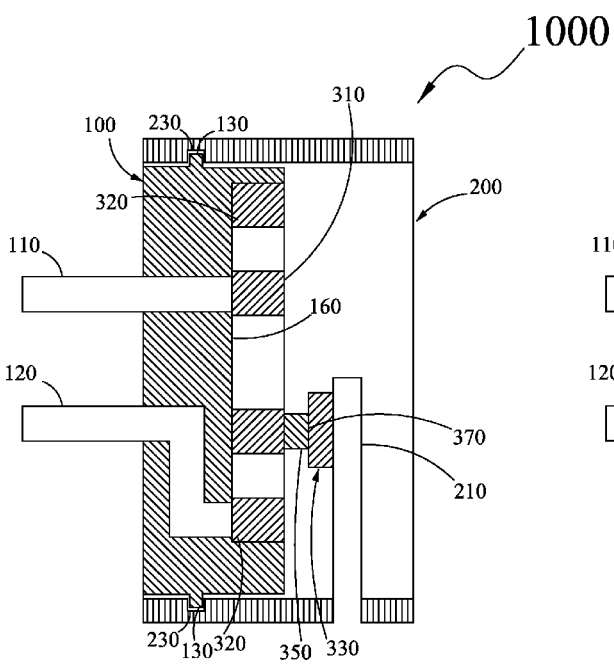
FIG. 5 is a sectional view of the adapter of FIG. 1 along a section line B-B', showing the adapter having a first female connector electrically coupled through a first conductive member to a first male connector.

The adapter 1000 may also include an electrical connection mechanism 300 as best shown in FIGS. 3A-3C. The electrical connection mechanism 300 may include a first conductive member 310 carried by the bottom connector 100. Specifically, the first conductive member 310 may be carried within the stepped-down surface 160 of the bottom connector 100. The first conductive member 310 may be configured to electrically couple the first male connector 110 with the first female connector 210. Accordingly, the first conductive member 310 may be composed of a conductive material, such as copper, aluminum, silver, and the like. However, other materials may be utilized in the composition of the conductive members without departing from the spirit and scope of the present disclosure. The first male connector 110 may pass through the stepped-down surface 160 to be fixedly attached to the first conductive member 310, as shown in FIGS. 3-5. In one form, the first conductive member 310 may be fixedly attached to the first male connector 110 through a soldering mechanism. Alternatively, other techniques may be utilized for attaching the first conductive member 310 to the first male connector 110, without departing from the spirit and scope of the present disclosure.

The electrical connection mechanism 300 may also include a second conductive member 320 carried by the bottom connector 100. Specifically, the second conductive member 320 may be carried within the stepped-down surface 160 of the bottom connector 100. The second conductive member 320 may be configured to electrically couple the second male connector 120 with the second female connector 220. Accordingly, the second conductive member 320 may be composed of a conductive material, such as copper, aluminum, silver, and the like. However, other materials may be utilized in the composition of the conductive members without departing from the spirit and scope of the present disclosure. The second male connector 120 may pass through the stepped-down surface 160 to be fixedly attached to the second conductive member 320, as shown in FIGS. 3-5. The second conductive member 320 may be fixedly attached to the second male connector 120 through a soldering mechanism. Alternatively, other techniques may be utilized to fixedly attach the second conductive member 320 with the second male connector 120, without departing from the spirit and scope of the present disclosure.

In one form, the first conductive member 310 and the second conductive member 320 ("conductive members") may be configured as rings and may be positioned on the stepped-down surface 160 such that concentric rings may be formed by the conductive members. In another form, the conductive members may be of any other shape without departing from the spirit and scope of the present disclosure.

The electrical connection mechanism 300 may also include a first contact blade 330 having a center portion 370. The first contact blade 330 may be configured to electrically coupling the first conductive member 310 with the first female connector 210. The first contact blade 330 may be longitudinally coupled to the first female connector 210, as depicted in FIGS. 3A-3C. In one form, the first contact blade 330 may be coupled to the first female connector 210 through a soldering technique. Alternatively, various other techniques may be utilized for coupling the first contact blade 330 to the first female connector 210 without departing from the spirit and scope of the present disclosure. Further, the first contact blade 330 may be composed of a conductive material such as copper, aluminum, silver, and the like, that may be capable of conducting electricity.

The electrical connection mechanism 300 may also include a first electrical brush 350 that may be configured to maintain electrical connectivity between the first conductive member 310 and the first female connector 210. Specifically, the electrical connectivity between the first female connector 210 and the first conductive member 310 may be established through the first contact blade 330 and the first electrical brush 350. The first electrical brush 350 may be electrically coupled to the first contact blade 330 (as shown in FIG. 5). Specifically, the first electrical brush 350 may be physically carried by the first contact blade 330 at the center portion 370 thereof through a soldering technique or a welding technique. Alternatively, the first electrical brush 350 may be carried by the first contact blade 330 by utilizing other techniques known in the art, without departing from the spirit and scope of the present disclosure. The first electrical brush 350 may be capable of sliding over the first conductive member 310. As mentioned previously, the first conductive member 310 may be carried by the first male connector 110. This arrangement may establish the electrical connectivity between the first female connector 210 and the first male connector 110. Further, this arrangement may enable the first female connector 210 to remain electrically coupled with the first male connector 110 even when the top connector 200 is rotated.

In one form, the first contact blade 330, the first female connector 210, and the first electrical brush 350 may be manufactured as a one piece blade structure.

The electrical connection mechanism 300 may also include a second contact blade 340 having a center portion 380. The second contact blade 340 may be configured to electrically coupling the second conductive member 320 with the second female connector 220. The second contact blade 340 may be longitudinally coupled to the second female connector 220, as depicted in FIGS. 3A-3C. In one form, the second contact blade 340 may be coupled to the second female connector 220 through a soldering technique. Alternatively, various other techniques may be utilized for coupling the second contact blade 340 to the second female connector 220 without departing from the spirit and scope of the present disclosure. Further, the second contact blade 340 may be composed of a conductive material such as copper, aluminum, silver, and the like, that may be capable of conducting electricity.

Figure 6:
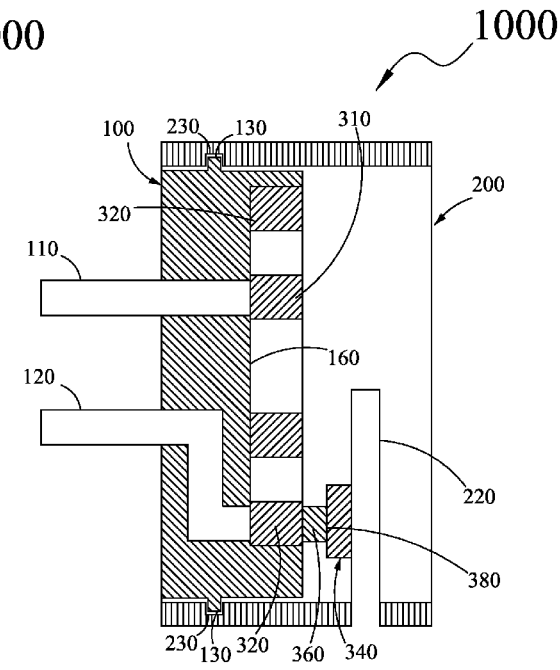
FIG. 6 is a sectional view of the adapter of FIG. 1 along a section line C-C', showing the adapter having a second female connector electrically coupled through a second conductive member to a second male connector.

The electrical connection mechanism 300 may also include a second electrical brush 360 that may be configured to maintain the electrical connectivity between the second conductive member 320 and the second female connector 220. Specifically, the electrical connectivity between the second female connector 220 and the second conductive member 320 may be established through the second contact blade 340 and the second electrical brush 360. The second electrical brush 360 may be electrically coupled to the second contact blade 340 (as shown in FIG. 6). Specifically, the second electrical brush 360 may be physically carried by the second contact blade 340 at the center portion 380 thereof through a soldering technique or a welding technique. Alternatively, the second electrical brush 360 may be carried by the second contact blade 340 by utilizing other techniques known in the art, without departing from the spirit and scope of the present disclosure. The second electrical brush 360 may be capable of sliding over the second conductive member 320. In one form, the second electrical brush 360 may be an electrical brush that may be carried by the second contact blade 340. As mentioned previously, the second conductive member 320 may be carried by the second male connector 120. This arrangement may establish the electrical connectivity between the second female connector 220 and the second male connector 120. Further, this arrangement may enable the second female connector 220 to remain electrically coupled with the second male connector 120 even when the top connector 200 is rotated.

In one form, the second contact blade 340, the second female connector 220, and the second electrical brush 360 may be manufactured as a one piece blade structure.

As delineated in FIGS. 3A-3C, a plurality of positions may be assumed by the female connectors when the female connectors are rotated clockwise or counter-clockwise. The rotation of the female connectors in the plane 12 is depicted. As best shown in FIGS. 3A-3C, the electrical connection between the female connectors and the male connectors may be maintained with the help of the electrical connection mechanism 300, as explained above. Further, the female connectors may be capable of being rotated 360 degrees in the plane 12, without breaking electrical connectivity with the male connectors. Furthermore, the electrical connection mechanism 300, as shown in FIGS. 3A-3C, may be configured to be accommodated within an enclosure (not shown) formed by the bottom connector 100 and the top connector 200, when assembled. The top connector 200 may be rotated to place the female connectors in various positions in the plane 12, when the male connectors on the bottom connector 100 are inserted into the wall socket 10.

In use, the male connectors of the adapter 1000 may be inserted into a neutral female connector and a live female connector of the wall socket 10. Similarly, the female connectors of the adapter 1000 may receive a neutral male connector and a live male connector of the electrical plug 16. The top connector 200 may be rotatable with respect to the bottom connector 100, thereby enabling the female connectors of the top connector 200 to be placed at various dispositions. Another adapter of the present disclosure is explained in conjunction with FIGS. 8-13.

FIGS. 8-13 depict perspective views of an embodiment of an adapter 2000 for an electrical plug 26.

The adapter 2000 may include a bottom connector 1100. The bottom connector 1100 may be cylindrical in shape with an outer curved surface 1150 and may include a socket plate 1140. The socket plate 1140 may be a flat circular surface that may contact a wall socket 20. The bottom connector 1100 may include a stepped-down surface 1160 at a circular surface opposite to the socket plate 1140 of the bottom connector 1100. The bottom connector 1100 may also include an annular rib 1130.

The bottom connector 1100 may also include a plurality of male connectors. The plurality of male connectors may include a first male connector 1110, a second male connector 1120 and a third male connector 1170 ("male connectors") (depicted in FIG. 8). The bottom connector 1100 may be similar to the bottom connector 100 of the adapter 1000 (of the first embodiment depicted in FIGS. 1-7) with an addition of the third male connector 1170. The male connectors of the adapter 2000 may be capable of being inserted into female connectors (not shown) of the wall socket 20. Specifically, the third male connector 1170 may be configured to be inserted in an earth female connector of the wall socket 20. Similar to the first male connector 1110 and the second male connector 1120, the third male connector 1170 may be carried perpendicularly with respect to the socket plate 1140. The third male connector 1170 may be carried by the bottom connector 1100 using an injection molding technique. Alternatively, the third male connector 1170 may be carried by the bottom connector 1100 by using other techniques. The third male connector 1170 may be cylindrical in shape. Alternatively, the third male connector 1170 may be of any other suitable shape. The third male connector 1170 may be composed of an electrically conductive material, such as, aluminum, copper, silver, and the like.

The adapter 2000 may further include a top connector 1200 similar to the top connector 200 of the adapter 1000. The top connector 1200 may be configured as a hollow cylinder with an inner curved surface 1240 for receiving the bottom connector 1100 therein. The top connector 1200 may include an annular groove 1230 configured on the inner curved surface 1240. In one form, the top connector 1200 may extend from the hollow cylinder into a cube or a cuboid having a flat surface 1270. The hollow cylinder of the top connector 1200 may be communicated with an opening 1250, an opening 1260 and additionally an opening 1280 that may be configured on the flat surface 1270.

The top connector 1200 may include a first female connector 1210, the second female connector 1220 and additionally a third female connector 1290 ("female connectors"). The third female connector 1290 may be configured to receiving a third pin (not shown) of the electrical plug 26. In one form, the third female connector 1290 may be carried within the top connector 1200 in the opening 1280. The third female connector 1290 may be positioned parallel to the first female connector 1210 and the second female connector 1220, and accordingly, perpendicular or at a right angle to the male connectors of the adapter 2000.

Figure 10A:
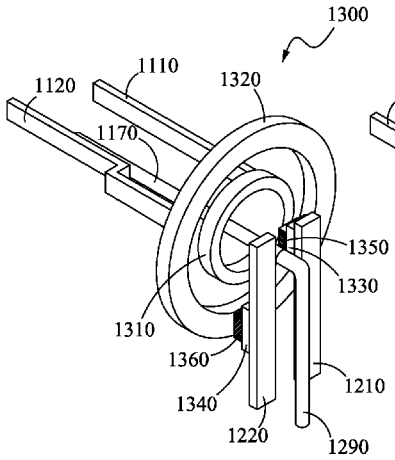
FIGS. 10A-10C are a series of three perspective views of an electrical connection mechanism of the adapter of FIG. 8 showing rotation of a plurality of female connectors carried by the top connector with respect to a plurality of male connectors carried by the bottom connector.
Figure 10B:
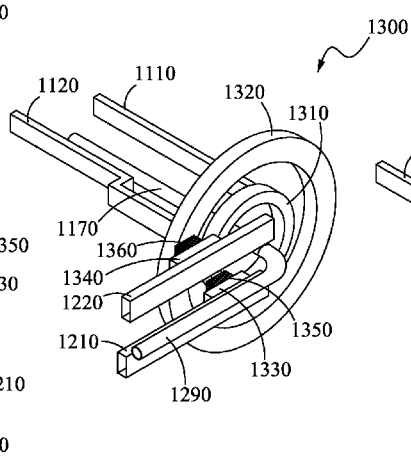
Figure 10C:
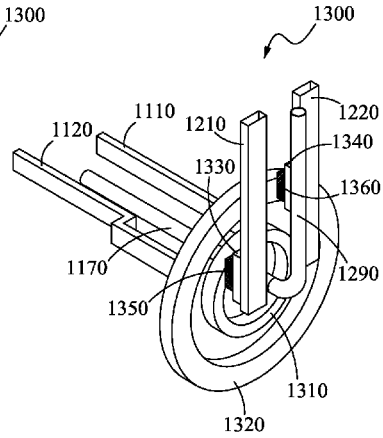
Figure 11:
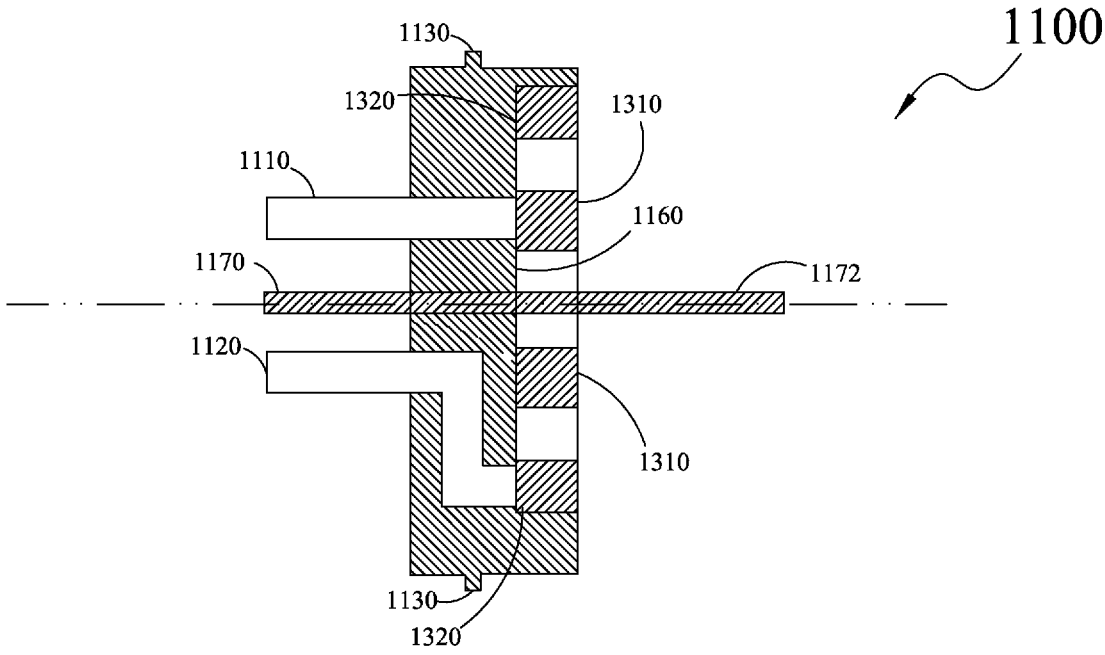
FIG. 11 is a sectional view of the bottom connector of the adapter of FIG. 8 along a section line D-D' (shown in FIG. 8), showing the bottom connector having the plurality of male connectors and the electrical connection mechanism.

The adapter 2000 may further include an electrical connection mechanism 1300 (See FIGS. 10A, 10B, & 10C). The electrical connection mechanism 1300 may include a first conductive member 1310, a second conductive member 1320, a first contact blade 1330, a second contact blade 1340, a first electrical brush 1350 and a second electrical brush 1360. The electrical connection mechanism 1300 of the adapter 2000 is similar to the electrical connection mechanism 300, as described for adapter 1000.

In one form, the first contact blade 1330, the first female connector 1210, and the first electrical brush 1350 may be manufactured as a one piece blade structure. Similarly, the second contact blade 1340, the second female connector 1220, and the second electrical brush 1360 may be manufactured as a one piece blade structure.

Figure 9:
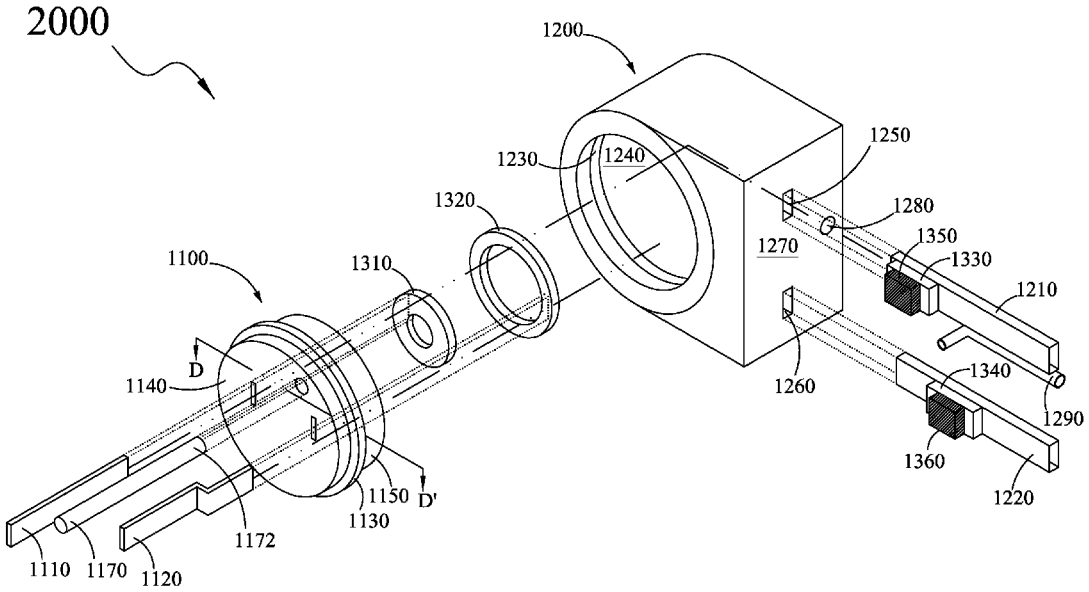
FIG. 9 is an exploded view of the adapter of FIG. 8, showing the adapter having a top connector, a bottom connector and an electrical connection mechanism.

Further, the third male connector 1170 may pass through the center of the concentric rings formed by the first conductive member 1310 and the second conductive member 1320 as best shown in FIGS. 9 and 10. The length of the third male connector 1170 may be relatively greater than the length of the first male connector 1110 and the length of the second male connector 1120. Specifically, a portion 1172 (shown in FIG. 11) of the third male connector 1170 may protrude perpendicularly outwards from the stepped-down surface 1160 of the bottom connector 1100 (as shown in FIG. 12).

Figure 12:
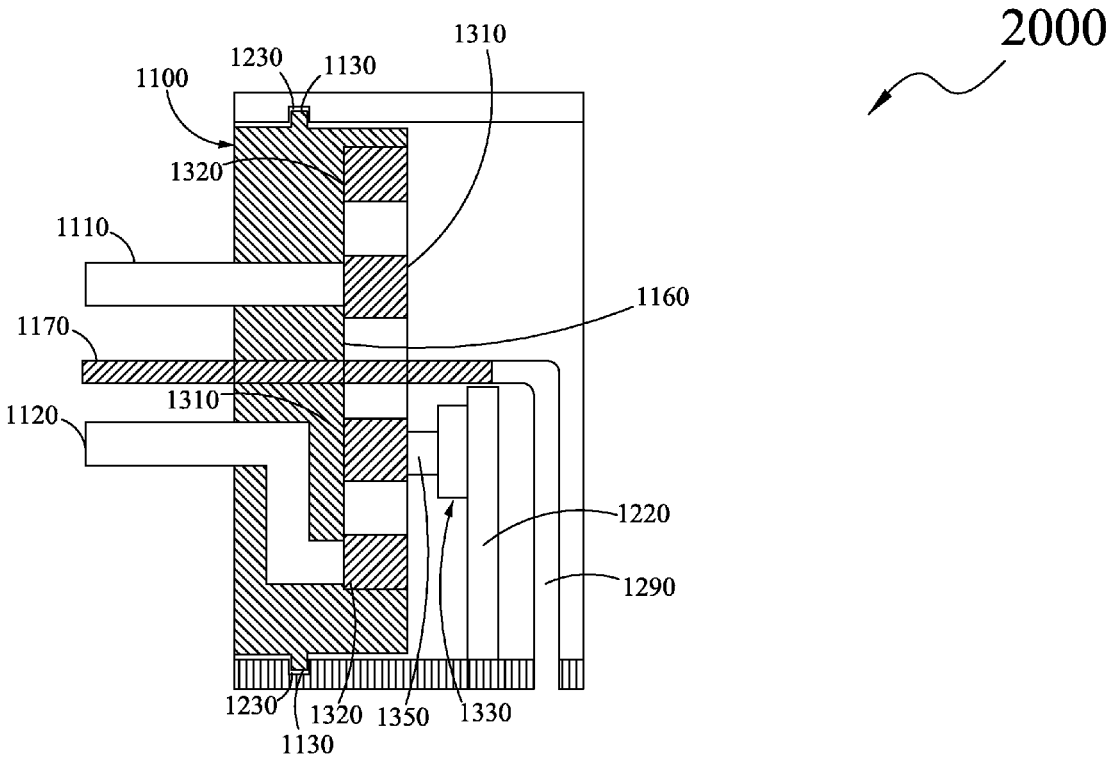
FIG. 12 is a sectional view of the adapter of FIG. 8 along a section line E-E', showing the adapter having a third female connector electrically coupled to a third male connector.

The third female connector 1290 may physically contact the third male connector 1170 to establish electrical connectivity between the third male connector 1170 and the third female connector 1290 (as shown in FIGS. 10 and 12). In an embodiment, the electrical connection mechanism 1300 of the adapter 2000 may include an electrical brush (not shown) that may be capable of coupling the third male connector 1170 and the third female connector 1290. The electrical brush may be carried by an end portion (not numbered) of the third female connector 1290 and may slide over the portion 1172 of the third male connector 1170.

Figure 13:
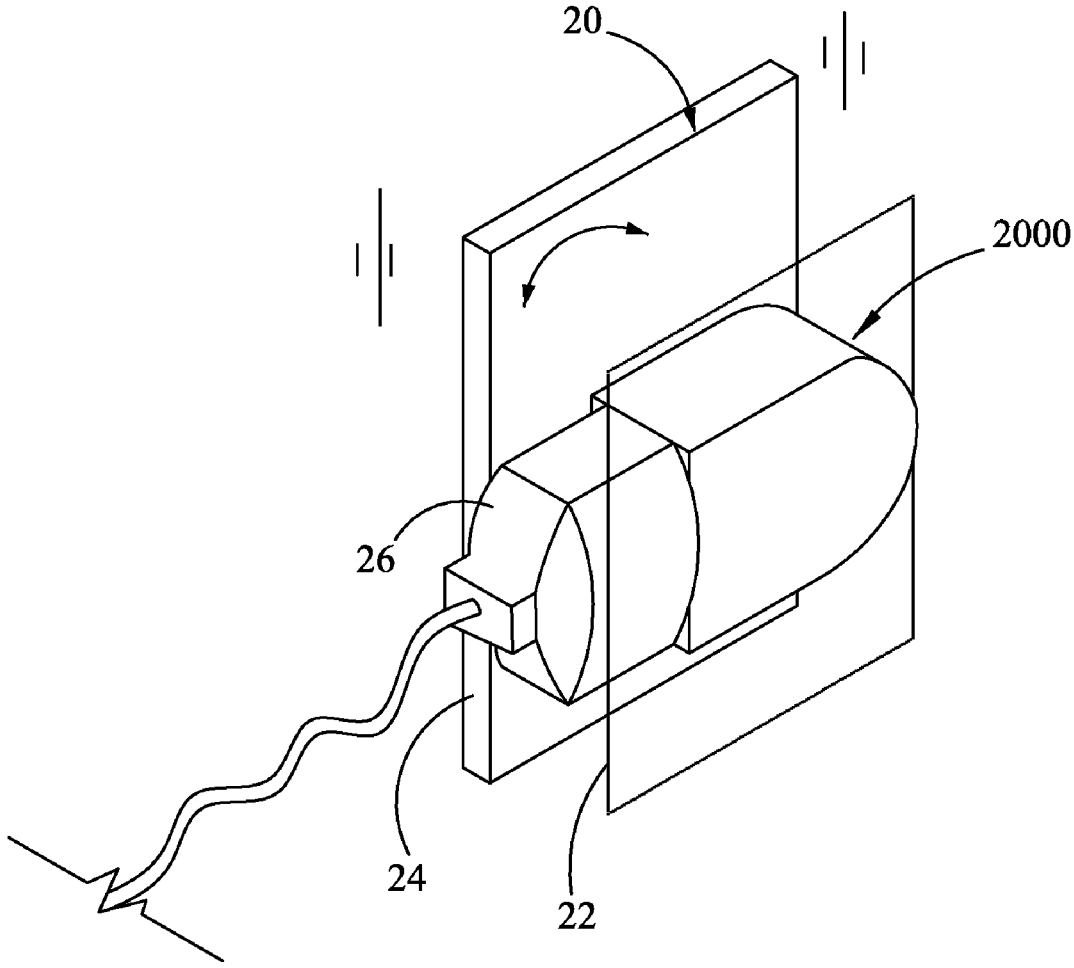
FIG. 13 is a perspective view of the adapter of FIG. 8 plugged into a wall socket.

As explained in the description for the adapter 1000, the female connectors of the top connector 1200 of the adapter 2000 may be capable of rotating in a plane 22 parallel to a plane 24 of the wall socket 20 (as shown in FIG. 13). Further, similar to the female connectors of the top connector 200 of adapter 1000, the female connectors of the top connector 1200 may be capable of rotating in both clockwise and anti-clockwise directions.

In operation, when the adapter 2000 is rotated, the third female connector 1290 may receive the portion 1172 of the third male connector 1170 for maintaining electrical connectivity therebetween. It will be apparent that the first female connector 1210 and the second female connector 1220 may be configured to rotate as explained in FIGS. 1-7.

An adapter, such as the adapter 1000 and the adapter 2000, of the present disclosure may be beneficial as it may enable a straight plug to be converted into an angle plug. The adapter may allow for flexibility in inserting an electrical plug into a wall socket. Further, since the electrical plug may be inserted into an adapter in a direction parallel to a wall socket, a lower profile of the arrangement may be formed. The lower profile may reduce accidental dislodging of the plug. Further, the lower profile may enable furniture to be placed abutting the arrangement. Still further, stress on a neck of the electrical plug may be reduced. Moreover, the adapter 2000 may be utilized for a two-prong electrical plug, without adding/removing any components.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omissions and substitutions of equivalents are contemplated as circumstance may suggest or render expedient, but such are intended to cover the application or implementation without departing from the spirit or scope of the claims of the present disclosure.

What is claimed is:

1. An adapter for an electrical plug, the adapter comprising:

a bottom connector comprising a plurality of male connectors, the plurality of male connectors capable of being inserted in a wall socket;

a top connector rotatably coupled to the bottom connector, the top connector capable of rotating in a plane parallel to a plane of the wall socket, the top connector comprising a plurality of female connectors configured for receiving the electrical plug, the plurality of female connectors electrically coupled to the plurality of male connectors, and disposed perpendicular to the plurality of male connectors; and a first conductive member configured for electrically coupling a first female connector of the plurality a female connectors to a first male connector of the plurality of male connectors, the first conductive member being electrical male connector so as not to move with respect to the first male connector.

2. The adapter of claim 1, further comprising, a second conductive member configured for electrically coupling a second female connector of the plurality of female connectors and a second male connector of the plurality of male connectors, a first electrical brush configured to maintain an electrical connectivity between the first conductive member and the first female connector, and a second electrical brush configured to maintain electrical connectivity between the second conductive member and the second female connector.

3. The adapter of claim 2, wherein the first electrical brush is electrically coupled to the first female connector, and wherein the first electrical brush is slidably carried by the first conductive member for maintaining the electrical connectivity between the first female connector and the first conductive member.

4. The adapter of claim 2, wherein the second electrical brush is electrically coupled to the second female connector, and wherein the second electrical brush is slidably carried by the second conductive member for maintaining the electrical connectivity between the second female connector and the second conductive member.

5. The adapter of claim 2 further comprising, a first contact blade configured to electrically coupling the first female connector and the first electrical brush, and a second contact blade configured to electrically coupling the second female connector and the second electrical brush.

6. The adapter of claim 2, wherein the first conductive member and the second conductive member form concentric rings.

7. The adapter of claim 6, wherein a third male connector of the plurality of male connectors passes through the center of the concentric rings.

8. The adapter of claim 7, wherein the third male connector is capable of being electrically connected to a third female connector of the plurality of female connectors.

9. The adapter of claim 1, wherein the plurality of female connectors is constantly electrically coupled to the plurality of male connectors.

10. The adapter of claim 1, wherein the bottom connector further comprises an annular rib configured on an outer curved surface thereof, and wherein the top connector further comprises an annular groove configured on an inner curved surface thereof, wherein the annular groove is capable of accommodating the annular rib therein for rotatably coupling the bottom connector with the top connector.

* * * * *

UNITED STATES PATENT AND TRADEMARK OFFICE

CERTIFICATE OF CORRECTION

PATENT NO. : 7,845,951 B1
APPLICATION NO. : 12/608041
DATED : December 7, 2010
INVENTOR(S) : Goon It is certified that error appears in the above-identified patent and that said Letters Patent is hereby corrected as shown below:

In the Claims:

Column 9, Claim 1, Line 39; Delete “electrical” and insert --electrically coupled to the first--.

Signed and Sealed this
First Day of March, 2011

David J. Kappos

David J. Kappos
*Director of the United States Patent and Trademark Office*